United States Patent [19]

Ray

[11] 4,025,283

[45] May 24, 1977

[54] ELECTRICAL IGNITION SYSTEMS FOR GAS FIRED EQUIPMENT

[76] Inventor: William A. Ray, 4241 Forman Ave., North Hollywood, Calif. 91602

[22] Filed: Mar. 18, 1976

[21] Appl. No.: 668,226

[52] U.S. Cl. ..... 431/45; 431/73

[51] Int. Cl.[2] ..... F23Q 9/14

[58] Field of Search ..... 431/45, 67, 73

[56] References Cited

UNITED STATES PATENTS

| | | | |
|---|---|---|---|
| 2,390,172 | 12/1945 | Ray | 431/45 |
| 3,083,758 | 4/1963 | Steghart et al. | 431/67 |
| 3,282,322 | 11/1966 | Steghart et al. | 431/67 |
| 3,306,339 | 2/1967 | Barton et al. | 431/73 |
| 3,395,968 | 8/1968 | Mobarry et al. | 431/45 |

*Primary Examiner*—Carroll B. Dority, Jr.
*Attorney, Agent, or Firm*—Edward C. Walsh

[57] ABSTRACT

Automatic electrical control systems for gas fired equipment. The systems embody electrical ignition. The systems eliminate the need for a constantly burning pilot. In one form, wherein the main burner is electrically ignited the pilot is omitted altogether. The systems are adapted to retrofit of existing systems having a pilot to provide for electrical ignition, eliminating constant burning of the pilot. Safety interlocks are embodied and responsive to a thermocouple, providing an assured safe and positive operation under all possible conditions.

11 Claims, 6 Drawing Figures

ELECTRICAL IGNITION SYSTEMS FOR GAS FIRED EQUIPMENT

BACKGROUND OF THE INVENTION

1. Field of the Invention

The field of the invention is that identified by the foregoing abstract. More particularly, the field of the invention is that of automatic control systems for gas-fired equipment embodying electrical ignition, which may be ignition of either a pilot burner or a main burner.

2. Description of the Prior Art

Many automatic control systems for gas-fired equipment are known to the prior art, especially typical systems utilizing a constantly burning pilot. Electrical ignition is not typical of prior art systems. There are currently in use large numbers of gas fired heating and other systems using constantly burning pilots which contribute to fuel shortages. The prior art lacks control systems providing for electrical ignition of a burner, and further lacks such a system having adequate characteristics of assured safety, economy, simplicity and dependability.

SUMMARY OF THE INVENTION

The invention is in the field of automatic electrical controls adapted primarily for use in gas fired equipment. The sytems of the invention embody electrical ignition whereby a pilot burner can be ignited or the main gas can be electrically ignited. The invention is adaptable to gas fired equipment in capacities of, for example, 400,000 btu's.

Present fuel shortages present the acute demand to limit fuel utilization to the maximum extent possible. Electrical ignition is provided to eliminate the constant burning pilot to save fuel and also to provide a convenient form of lighting the equipment for the use which is available for each start up of the main burner.

In the exemplary form of the systems as disclosed herein, generally, there is used a thermocouple which is a flame detector although other types of flame detectors could be used which produce a steady or pulsing type signal with a component of direct current. An appropriate signal is obtainable by flame rectification electrodes, light cells, negative coefficient elements, radiation responsive tubes, or similar flame detectors with output signals from a fraction of a millowatt to a few millowatts. A primary purpose and objective is to have the capability of using simple circuitry and electro-mechanical component and to avoid sophisticated electronics or components which often require redundant systems and designs to minimize failure or false signals. The reliability of direct current holding magnets is well known and proven by millions of units with reliability records as high as human ingenuity and workmanship can make them. Although the combination of a thermocouple and a holding magnet is low in cost/reliability, the lack of available energy does not lend itself to automatic or self-actuating systems. All of the systems as proposed herein are aimed at a low cost solution, and making it possible to retrofit or apply to new installations while retaining the closed circuit features inherent in the basic concept.

Circuits are provided which are adapted to retrofit of existing gas fired units already equipped with an electric valve which may be of practically any type and with a pilot burner and thermocouple arranged to meet the requirements and approval of the American Gas Association. Adding the electrical ignition capability as in these circuits does not in any way alter the conditions of the existing pilot burner and the proper monitoring of the pilot frame by the thermocouple or the integrity of the approval of the American Gas Association. The capabilities of the herein circuit systems can be adapted to new installations and equipment.

The herein invention provides systems embodying a particular combination of basic functions, including that of a logic relay, time delay, and spark package. A controlling contact of a valve may be controlled directly by the system, making it possible to readily change over existing constantly burning gas pilot installations to automatic electrical ignition installations.

A primary object of the invention is to make it possible to entirely eliminate the need for constantly burning pilots by means of automatic ignition, and further if desired to eliminate the pilot burner itself and its line. It is an object to provide this capability for both new and retrofit systems.

Further objects related to the electrical ignition include that of assuring starting coil current level by providing reverse connected diodes in the energizing and holding circuits of the start circuit relay so each circuit operates independently on its half cycle of the alternating current power wave.

Another object is to realize flexibility in connecting the generator/ignition source for either initial ignition only or continuing ignition as may be desired or appropriate.

Another object is to realize, dependably, shut down with a purge peroid after current failure; or after resetting thermostat or any supply circuit interruption; or the flame detector signalling absence of flame.

Further objects reside in realizing the following characteristics:

A. Impossibility of having main valve on while the relay reset or start circuit is energized, because of the physically non-reduceable contact gap in single pole, two contact Delay Switch; i.e., the normally closed and the normally open contact cannot be made at the same time.

B. Ease and safety of resetting system after "lockout" by operating or changing the thermostat setting or switch remotely and safely at the thermostat location.

Further objects are to realize the following characteristics in systems having pilot burners:

A. Pilot burner ignition, or two-step operation.

B. Electrical lockout should the pilot burner not light or be extinguished.

C. Start up by proving pilot burner first (i.e.: the pilot flame) with its small and accordingly safer gas consumption.

D. Pilot burner gas is shut off should pilot not ignite or be extinguished as well as the main burner valve, realizing a 100% shutoff system.

E. System and all valves shut off immediately when current supply is interrupted with purge period if beyond ignition period.

The invention makes possible a unit package whereby it is adapted readily to retrofit existing systems in a way such that an installer could retrofit several existing systems per day. Thus, this would cut off the pilot loads which in a single city such as one the size of Los Angeles, could run into millions of cubic feet of gas per hour.

BRIEF DESCRIPTION OF THE DRAWINGS

Further objects and additional advantages of the invention will become apparent from the following detailed description and annexed drawings, wherein.

DESCRIPTION OF THE PREFERRED EMBODIMENTS

Figure 1:
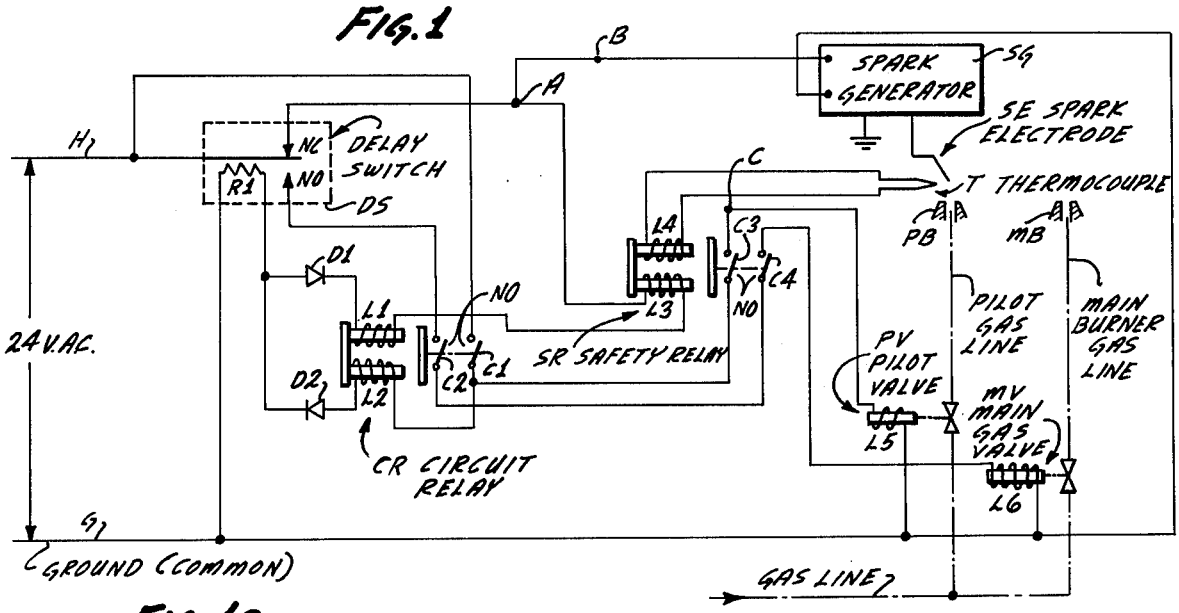
FIG. 1 is a circuit diagram of a preferred form of system embodying direct control of the main gas valves.

A preferred system is shown in FIG. 1. It may receive power from a 24 volt alternating current source, the lines being H and G. The delay switch is identified by the character DS. It has a heat responsive switch blade operable between a normally closed contact NC and normally open contact NO. The switch is operated by a heating element R1. The NO contact closes in response to heat after a delay of a predetermined time, which might be from 45 to 90 seconds, for example.

The character CR identifies the start or circuit relay. It has two windings, L1 and L2, associated with separate electromagnetic cores, both cores being associated with the armature, as shown. The armature operates two switches or switch contacts designated C1 and C2. The characters D1 and D2 designate two diodes connected in reverse as shown in the curcuits of windings L1 and L2 respectively. These diodes isolate the two phases of the AC supply in the circuit of the resistance R1. Winding L2 is of very low resistance and when its circuit is energized as described hereinafter, it substantially or effectively short-circuits windings L1 and L3 with the result that without the two diodes one or the other of windings L3 or L1 might not pull in because the short would not be permitting enough current for this to happen. This possibility is obviated by the two diodes, each diode working on half of the AC wave. The series circuit through the windings L1 and L3, is isolated by the diode arrangement. Thus, the relays are on independent circuits so that the voltage acting on them remains constant.

The character SR designates the safety relay having windings L3 and L4 associated with separate cores as shown. Both cores are associated with the armature as shown, which actuates two switches or switch contacts as designated at C3 and C4.

The character SG designates a spark generator, which may be of conventional construction being grounded as shown and capable of producing a high-voltage spark when energized with the spark electrode as designated by the character SE. The character T designates a thermocouple positioned in the flame of the pilot burner PB. The character MB designates the main burner.

The character PV designates the pilot valve which has an electromagnetic actuator including a winding L5.

The character MV designates the main gas valve which has an electromagnetic actuator including the winding L6. The gas lines are diagrammatically indicated.

The spark generator is preferably energized directly from the NC contact point B being connected to point A. Alternatively point B can be connected to contact C3.

NORMAL OPERATION (FIG. 1)

FIG. 1 shows the system in "off" condition.

Current is supplied by closing thermostat contacts, for example, whereupon current flows through the NC Delay Switch contact, energizing coils L1 and L3 and pulling in both relays CR and SR through diode D1; i.e.: both circuit and safety relays.

Contact C1 now closed energizes coil L2 on the other half of the AC cycle. Diodes D1 and D2 are connected in opposite directions, thus, coils L1 and L3 are active on one half of the AC cycle and coil L2 is active on the other half of the cycle.

The above events occur in the space of a few milliseconds and result in operating the pilot valve PV and the spark generator SG and normally in igniting the pilot burner PB flame.

Electric current flows through both diodes D1 and D2 (an unbalanced AC wave due to different circuit parameters) and through heater coil R1 thereby heating the Delay Switch actuator, which is a thermally responsive actuator. The pilot flame is now heating thermocouple T and starting current generation which flows through coil L4.

If normal operation continues, sufficient current will be generated by thermocouple T which flowing through winding L4 will hold in (but not pull in) safety relay SR. This is one of the significant features of the system. The Delay Switch DS and the particular construction of the safety relay SR itself, and the insured separation of contacts NO and NC in the Delay Switch DS are all significant to this operation. The thermocouple T only generates usable energy from 2 millivolts on up, and from 200 microwatts on up, and the objective is realized of amplifying and utilizing this weak signal without resorting to a very expensive and not always reliable sensitive relay or electronic amplification. Further, the delay switch DS is timed as to interval so that it does not try to prove the pilot flame until adequate generation by the thermocouple exists which is in this system about 45 seconds. Hi-speed thermocouples or other forms of detectors might take less time but usually would require a more sophisticated and more expensive relay and more amplification.

When the foregoing events are realized (i.e., closing of NO delay switch contact and safety relay holding) the circuit to main valve MV is completed through C2, C4 and L6, admitting gas to main burner which will be ignited by established and proven pilot burner flame. The Delay Switch DS continues to be heated electrically and adequately through heater R1, diode D2 and holding coil L2 on circuit relay, CR.

Normal shut-off operation is as follows:

If the pilot/main burner are operating normally either during or after starting cycle, it is only necessary to shut off the supply current which drops out the circuit relay, closing main and pilot valves. Then heater R1 starts to cool as well as the thermocouple T. After cooling/delay period of Delay Switch DS (45 to 90 seconds, for example), the system can be restarted at any time.

ABNORMAL CONDITIONS

If the pilot burner did not light or thermocouple not generate on start up as outlined in the foregoing, then when the Delay Switch operates, it will close NO contact, after first opening NC contact in which case winding coil L3 is de-energized and coil L4 is not energized by the thermocouple causing safety relay dropout and opening contacts C3 and C4 resulting in closing pilot valve and preventing the main valve from opening. However, because of contact C1 the circuit relay will still hold in and heater R1 will still heat the delay switch. This is the LOCKOUT condition and will continue indefinitely as long as 24 volt AC power is supplied.

Abnormal Condition Due to Flame Out or Thermocouple Failure

This may occur while the main burner is on. After completing normal start up as described above with burners operating normally, if flame failure as indicated by the thermocouple occurs minutes or even hours later, then the safety relay drops out as the thermocouple ceases to generate and accordingly both main and pilot gas valves are turned off. This again results in LOCKOUT as described above which will continue as long as 24 volt current is supplied.

Correcting or Resetting an Abnormal or Lockout Condition

As mentioned above, a LOCKOUT condition continues as long as current is ON. It is only necessary to interrupt the supply circuit momentarily by switching same off at the thermostat, for example, causing the circuit relay to drop out, breaking the hold current to coil L2 and cutting off current to Delay Switch heater R1. The LOCKOUT is ended and system may or can restart after a delay or purge period for Delay Switch actuator to cool, with the particular components described this being about 45 to 90 seconds, allowing any unburned gasses to clear from the combustion chamber/main burner.

The system then reacts in one of two ways, as follows: If current on/restored, then a new cycle is started for a normal start, or if supply current is off, then nothing occurs until a call for heat occurs, current is restored, and the system goes through the start cycle as described above with probably a successful conclusion as original cause of failure was most likely not permanent.

This system is straightforward, reliable and simple and with present and prospective energy shortages and limitations, it is badly needed and its merit should be readily recognized.

Figure 1A:
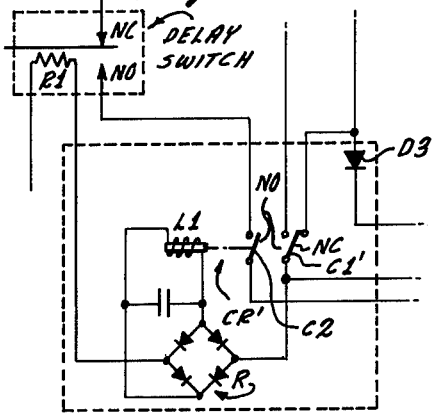
FIG. 1*a* is a modification of FIG. 1.

FIG. 1*a* shows a modification of the circuitry of FIG. 1. Relay CR′ and rectifier R substitute for relay CR and its diodes. The relay CR′ and full wave rectifier R provide a power supply with condenser CR′ substituted for relay CR of FIG. 1. Relay CR′ has contact blades C1 and C2, C1′ being single pole double throw having a normally closed contact NC. Included in this modification is the diode D3 in the line to coil L3 to allow DC relay design. This is a parallel arrangement of coils L3 and L1 rather than a series arrangement as in FIG. 1. FIG. 1*a* is otherwise like that of FIG. 1. This makes possible the use of a single coil relay which is a lower priced relay. When they are in parallel the two circuits can be isolated. The isolation is achieved by way of the additional NC contact. The operation is otherwise like that described for FIG. 1.

Figure 2:
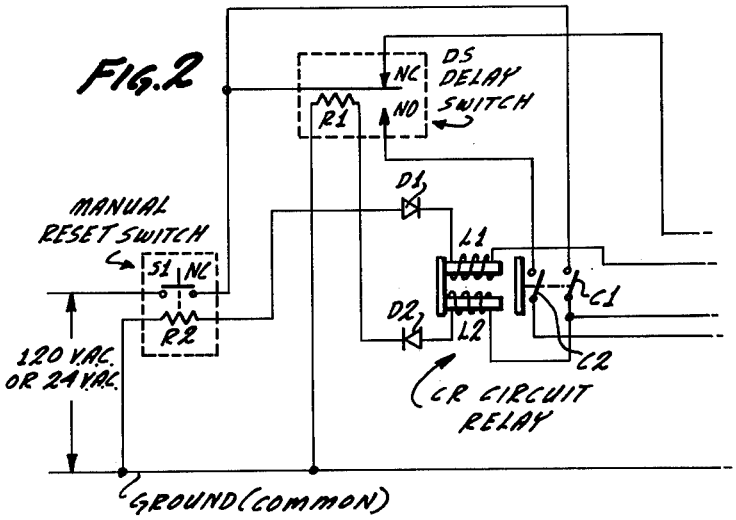
FIG. 2 is a circuit diagram modification of the system of FIG. 1 embodying a manual reset switch.

FIG.2 is like the system of FIG. 1, the same reference characters and legends being used except that it embodies the manual reset switch S1. This switch has a normally closed NC contact as shown, which can be opened in response to heat by heater R2. This modification is to meet the requirements of underwriters that a manual reset switch be built into the circuit. The circuit of heating resistor R2 is controlled by the diode D1 and the circuit of winding L1 and L3 as in FIG. 1. Resistor R1 is in circuit only with diode D2. In this circuit, the attempt or trial to successfully ignite and open the main valve cannot be pursued indefinitely since the circuit of diode D1 after a predetermined interval of trying will cause the heater resistance R2 to open the switch S1 and after it opens, manual closure is required. As may be seen, opening of this switch interrupts power to the system. Thus, ever is the NC contact of DS stuck in the closed (NC) position, the power would be cut off.

Figure 3:
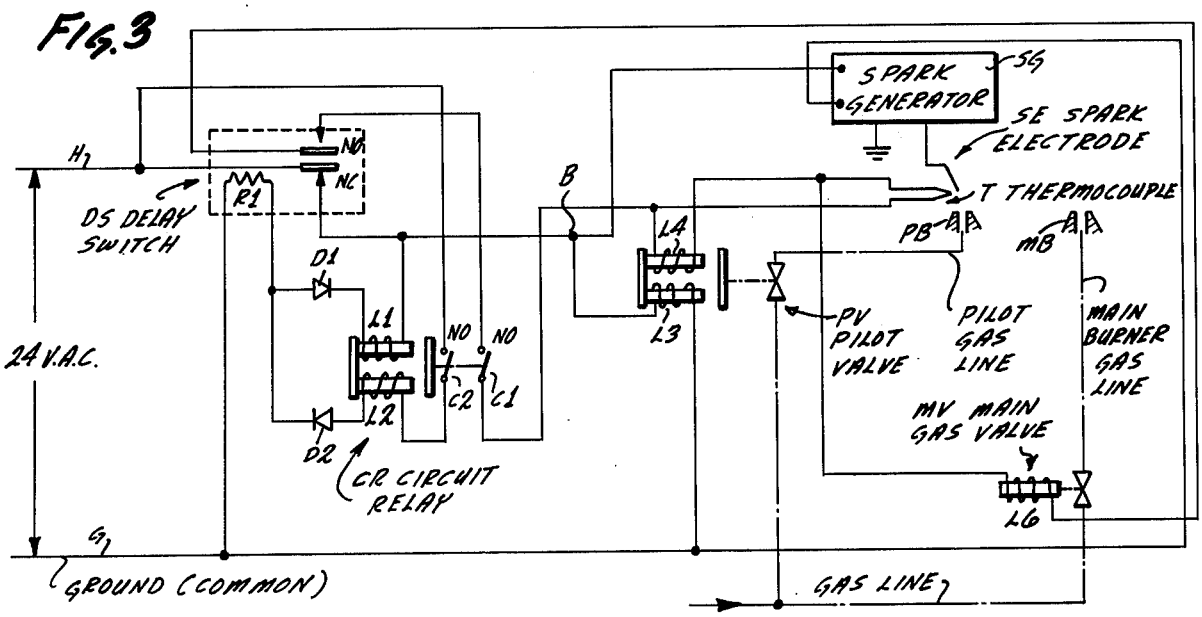
FIG. 3 is a circuit diagram of a modification of the system of FIG. 1 wherein the electromagnetic activator of the pilot valve includes a holding winding, in lieu of the safety relay of FIG. 1.

FIG. 3 shows another form of the system wherein the safety relay SR is omitted and instead the pilot valve PV is operated by an electromagnetic actuator having an armature connected to the valve, the actuator having the two windings L3 and L4, each associated with a separate core. In this system the circuits of the NO and NC contacts of the delay switch are isolated from each other, there being two switchblades as shown. The system of this figure is ideally adapted to retrofit of systems having an electro-magnetic pilot valve controlled and powered by a flame sensor but not having electric ignition.

The operation of this system is as follows. Upon a demand from the controlling instrument a circuit is completed through the contact NC, winding L1 and diode D1, and resistor R1 for energizing the relay CR. At the same time a circuit is completed through contact NC and winding L3 to energize the actuator of the pilot valve PV. The relay contact C2 completes a holding circuit for relay CR through winding L2 and diode D2 and the heater R1. Contact NC completes a circuit to the spark generator but alternatively contact C1 may complete a circuit to the spark generator so that it produces a spark at the spark electrode. Upon opening of the pilot valve and energization of the spark electrode, normally the pilot burner is ignited.

After the delay period of the delay switch DS the contact NO closes (before NC opens) completing a circuit for opening the main valve MV, which is through the winding L6 through the contact through the thermocouple T, contact C1 of relay CR and back to the NO contact delay switch DS. Contact NO closes before contact NC opens. Closure of the NO also completes a circuit from it through winding L4 and the thermocouple T. As can be seen, power for actuating the main gas valve and winding L4 is supplied by the thermocouple. If it has not responded, windings L4 and L6 will not be energized and the main gas valve will not open. When NC opens, winding L3 will be de-energized and the spark generator and coil L3 will be de-energized and the pilot valve will close. The system will be in a lockout condition. Point B can alternately be connected to energize SG through contact C1.

In the event normal operation comes about and at any time the thermocouple fails to respond, windings L4 and L6 will not be energized and both the pilot valve and the main valve will close. The system will stay in this condition since relay CR remains energized and the circuit of heater R1 remains energized.

Figure 4:
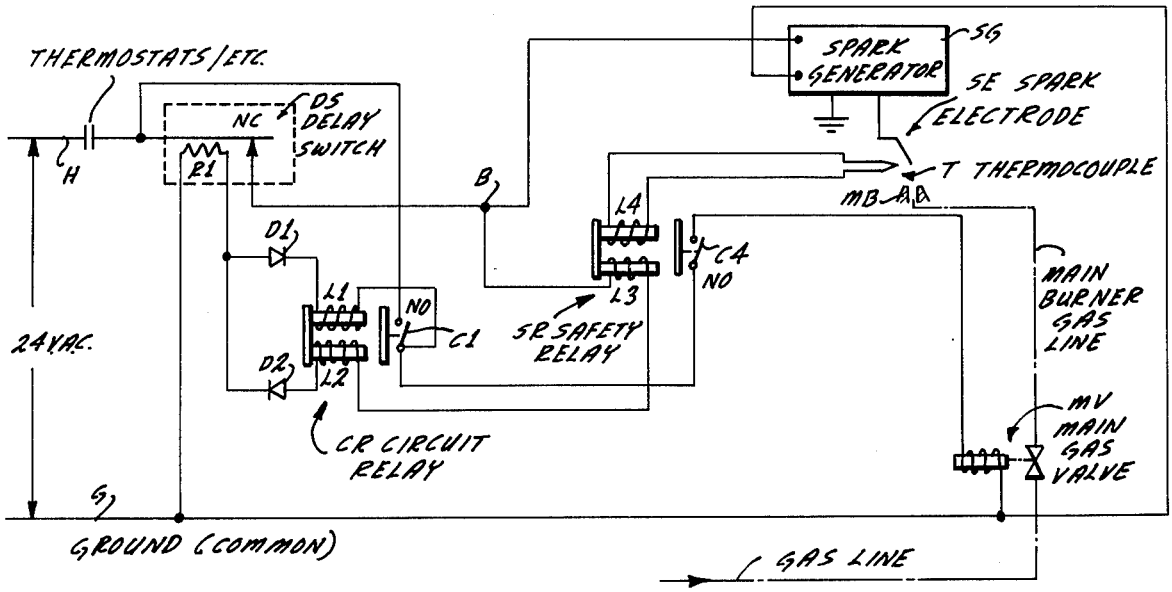
FIG. 4 is a circuit diagram of a system not embodying a pilot burner.
Figure 5:
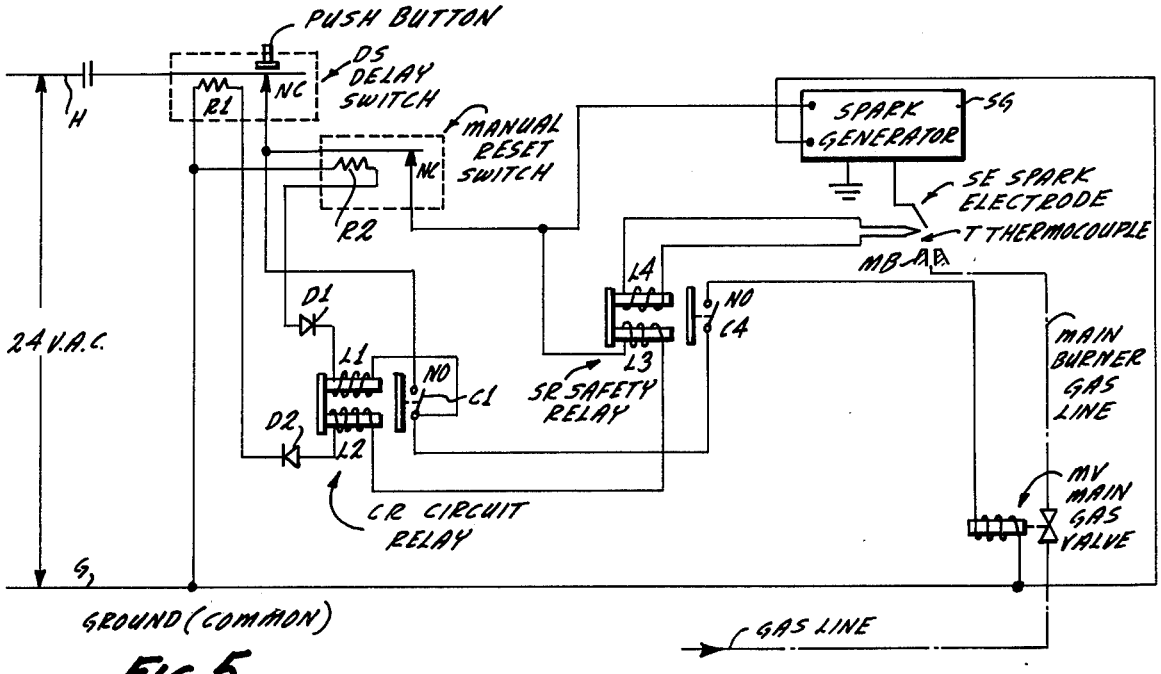
FIG. 5 is a circuit diagram of a system like FIG. 4 with lockout requiring reset.

FIGS. 4 and 5 show systems with no pilot burner or pilot burner line. In these systems, the main burner is electrically ignited.

Relay CR has only the contact Cl and Relay SR has only the contact C4. Reference characters are used corresponding to those of FIGS. 1—3.

The operation is essentially similar to that of FIG. 1 but without the pilot valve and pilot burner actuation. Upon a demand from the controlling instrumentality a circuit is completed through contact NC, windings L3, L2, diode D2 and resistor R1. Both relays pull in and contact C1 completes the holding circuit for L1 through D1 and R1. It also completes a circuit through contact C4 for opening the main valve. The spark generator SG may be energized directly by contact NC or relay contact C1, if point B is connected to it. When the thermocouple responds coil L4 will be energized to hold in the safety relay SR. If the thermocouple has not responded when contact NC opens, relay C4 will drop out de-energizing the main valve. Similarly, at any time during operation, if the thermocouple fails to respond, relay SR will drop out. Resistor R1 remains energized and the system will stay in this condition until corrected.

The circuitry of FIG. 5 is like that of FIG. 4 with the addition of a push button actuator for the delay switch and of a manual reset switch like that of FIG. 2, which operates similarly. It has a normally closed contact and switch blade actuated by resistor R2 which is in the circuit of diode D1, which if not interrupted, will cause the NC contact of the reset switch to open requiring manual reset by the push button. The operation is otherwise like that already described.

From the foregoing, those skilled in the art will readily understand the manner in which the objects set forth in the foregoing are realized.

The foregoing disclosure is representative of preferred forms of the invention and is to be interpreted in an illustrative rather than a limiting sense, the invention to be accorded the full scope of the claims appended hereto.

What is claimed is:

1. An automatic electrical control system for gas fired equipment having burner means adapted for usage without a constantly burning pilot, comprising in combination; electric ignition means positioned for igniting a burner, a main valve means for controlling flow to a main burner; electrical means for controlling actuation of the main valve means; flame responsive means adapted to produce an electrical signal; electrical connections whereby said flame responsive means controls said electrical means for maintaining said main valve in open position, control circuit means responsive to a control instrumentality, said control circuit means including time-delay switch means and circuit means for initial energizing said electrical ignition means and said electrical means for opening the main valve, and circuit means whereby said time delay means shifts control of said main valve means to said flame responsive means after a time delay.

2. A system as in claim 1, wherein said control circuit means includes a relay having energizing and holding circuits and having relay contacts and circuit means whereby said relay contacts control said electrical means.

3. A system as in claim 2, wherein said time-delay means comprises a heat responsive actuator and a heater, said relay energizing and holding circuits each having a diode therein, the diodes being connected in reverse and each being in circuit with said electrical heater.

4. A system as in claim 2, wherein said electrical means controlling said main valve includes a safety relay having energizing and holding circuit means, and circuit means whereby said holding circuit means is energized by said flame responsive means.

5. A system as in claim 4, including a pilot burner and pilot valve and circuit means whereby the said pilot valve is controlled by said safety relay.

6. A system as in claim 1, including a manually re-settable safety switch in circuit with said time delay switch means, said manually resettable switch including a heat actuatable member and a heater and said heater being in circuit with said initial energizing circuit.

7. A system as in claim 1, wherein said time delay means has a normally closed contact which opens after a pre-determined interval and circuit means connected to said contact whereby said contact controls energization of said electrical means.

8. A system as in claim 1, including a pilot burner, a pilot valve and electro-magnetic means for actuating the pilot valve, and circuit means whereby the time delay means shifts control of said pilot valve to said flame responsive means.

9. A system as in claim 8, wherein the said electromagnetic means for actuating the pilot valve includes an energizing circuit and a holding circuit, and connections whereby the said flame responsive means controls the said holding circuit.

10. A system as in claim 1, said electric ignition means being positioned for igniting the main burner.

11. A system as in claim 4, wherein the said electric ignition means is positioned to ignite the said main burner.

* * * * *